US005114450A

United States Patent [19]

Paradowski et al.

[11] Patent Number: 5,114,450

[45] Date of Patent: May 19, 1992

[54] METHOD OF RECOVERING LIQUID HYDROCARBONS IN A GASEOUS CHARGE AND PLANT FOR CARRYING OUT THE METHOD

[75] Inventors: Henri Paradowski, Cergy; Michel Leroy, Domont, both of France

[73] Assignee: Compagnie Francaise D'Etudes et de Construction-Technip, France

[21] Appl. No.: 513,558

[22] Filed: Apr. 24, 1990

[30] Foreign Application Priority Data

Apr. 25, 1989 [FR] France ..... 89 05488

[51] Int. Cl.[5] ..... F25J 3/02; F25J 3/06; F25J 3/00

[52] U.S. Cl. ..... 62/24; 62/23; 62/41

[58] Field of Search ..... 62/23, 24, 27, 28, 31, 62/32, 36, 41

[56] References Cited

U.S. PATENT DOCUMENTS

| | | | |
|---|---|---|---|
| 3,150,199 | 9/1964 | Greco et al. | 62/24 X |
| 4,121,917 | 10/1978 | Baker et al. | 62/41 X |
| 4,235,613 | 11/1980 | Castoe et al. | 62/24 X |
| 4,285,708 | 8/1981 | Politte et al. | 62/23 X |
| 4,370,156 | 1/1983 | Goddin, Jr. et al. | 62/24 X |
| 4,690,702 | 9/1987 | Paradowski et al. | 62/23 |
| 4,705,549 | 11/1987 | Sapper | 62/24 X |
| 4,707,171 | 11/1987 | Bauer | 62/24 X |
| 4,772,301 | 9/1988 | Bauer | 62/41 X |
| 4,897,098 | 1/1990 | Pate et al. | 62/24 X |
| 4,976,849 | 12/1990 | Soldati | 62/23 X |

*Primary Examiner*—Henry A. Bennet
*Assistant Examiner*—Christopher B. Kilner
*Attorney, Agent, or Firm*—Steinberg & Raskin

[57] ABSTRACT

A method of and a plant for recovering liquid hydrocarbons in a gaseous batch, the plant comprising a compressor for the gaseous batch, a column for absorbing C5 and heavier hydrocarbons associated with a debutanization column; a column for absorbing C3 and heavier hydrocarbons associated with a de-ethanization column and with a heat exchange system connected to a refrigeration cycle, the plant providing from a gaseous batch issuing from a catalytic cracking unit a debutanized gasoline, a liquefied gas cut (C3 and C4-hydrocarbons) and a gaseous cut (C2 and lighter hydrocarbons) wherein the losses of C3 and higher C-hydrocarbons are much smaller than that occurring with existing plants.

8 Claims, 2 Drawing Sheets

Figure 1:
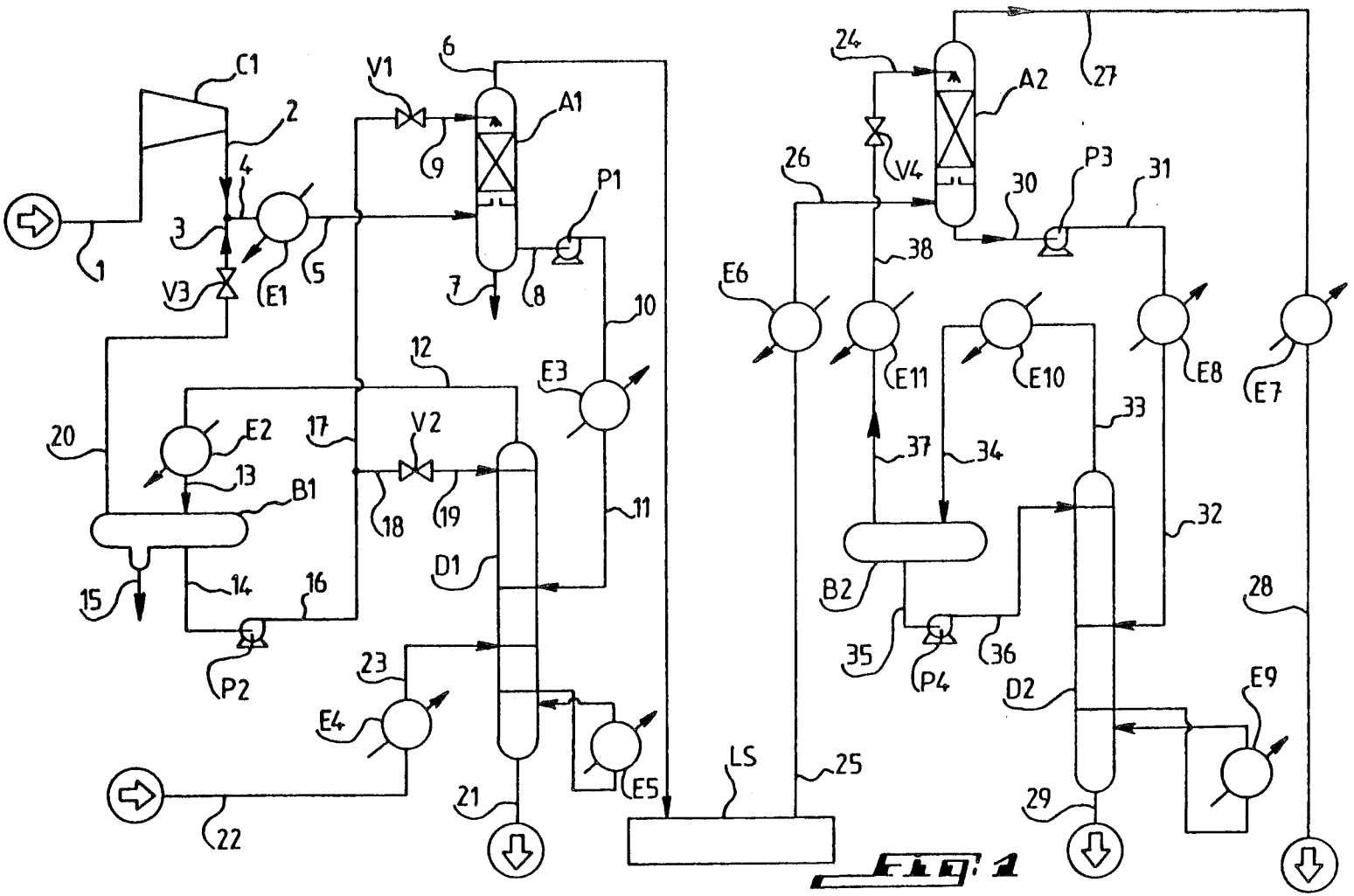

METHOD OF RECOVERING LIQUID HYDROCARBONS IN A GASEOUS CHARGE AND PLANT FOR CARRYING OUT THE METHOD

The present invention relates essentially to a method of recovering liquid hydrocarbons from a gaseous charge, load or batch consisting essentially of hydrocarbons and originating for instance from a unit for processing petroleum fractions by catalytic cracking.

The invention is also directed to a plant, system or device for carrying out this method.

There has already been proposed industrial plants allowing to recover C5, C4 and C3-hydrocarbons in gaseous charges, loads or batches originating from a catalytic cracking.

In a general manner in these known plants the gaseous load or batch is compressed, partially condensed and then fed into absorbers arranged in series which would absorb the C3 and heavier hydrocarbons to produce a gas containing lighter hydrocarbons. The whole of the liquid hydrocarbons collected at the bottom of the absorber is treated in a column to remove the light C2 and less heavy compounds.

This kind of plants however does not allow to extract more than 95% of the C3-hydrocarbons, 98% of the C4-hydrocarbons and 99.5% of the C5-hydrocarbons contained in the batch under favorable conditions. More usually under normal conditions there are recovered at the best 90% of the C3-hydrocarbons, 97% of the C4-hydrocarbons and 99% of the C5-hydrocarbons contained in the batch. It results therefrom that such plants do not have an outstanding output efficiency, yield or effectiveness.

The object of the present invention is to cope with this difficulty or inconvenience by providing a method allowing to extract the total content of the C5 and C4-hydrocarbons and at least 98% of the C3-hydrocarbons.

For that purpose the subject matter of the invention is a method of recovering liquid hydrocarbons contained in a gaseous charge, load or batch issuing for instance from a unit for the treatment of petroleum cuts through catalytic cracking and of the type consisting in compressing the charge, batch or load, condensing it partially and injecting it into a first absorber to produce at the head a preprocessed gas and at the bottom heavy hydrocarbons which are processed in a first distillation column allowing to remove the light hydrocarbons to produce heavy hydrocarbons, the method also consisting in washing and drying the preprocessed gas and then in cooling it down and in injecting it into a second absorber to produce at the head the treated gas and at the bottom the liquid hydrocarbons which are processed in a second distillation column allowing to remove the light hydrocarbons to produce heavier hydrocarbons, the method being characterized in that:

the heavy hydrocarbons at the bottom of the first absorber are injected after possible reheating thereof into a debutanization column to obtain on the one hand at the bottom of this column a liquid cut which contains the whole amount of the C6 and heavier hydrocarbons, at least 99% of the C5-hydrocarbons, at most 2% of the C4-hydrocarbons present in the batch and which is fully free or devoid of C3 and lighter hydrocarbons and on the other hand at the head of this column a liquid cut rich in C4 and lighter hydrocarbons which is reinjected as a reflux into the said column and as a feed into the head of the first absorber and a gaseous distillate recycled to the gaseous batch upstream of the first absorber and the liquid hydrocarbons at the bottom of the second absorber are injected after having being reheated into a de-ethanization column to obtain on the one hand at the bottom of this column a cut which contains at least 98% of the C3-hydrocarbons and the total amount of the C4-hydrocarbons present in the pretreated gas and on the other hand at the head of this column a liquid cut rich in C2 and lighter hydrocarbons which are reinjected as a reflux into the said column and also a gaseous distillate rich in C2 and lighter hydrocarbons which after refrigeration and at least partial condensation is injected as a feed into the head of the second absorber, so that the method allows to recover at least 98% of the C3-hydrocarbons and at least 99.9% of the C4 and higher C-hydrocarbons contained in the gaseous batch whereas the pretreated gas issuing from the first absorber contains the total amount of the C3 and lower C-hydrocarbons, at least 98% of the C4-hydrocarbons, at most 1% of the C5-hydrocarbons and that it is fully devoid or free of C6 and higher C-hydrocarbons.

According to another characterizing feature of this method the debutanization column operates at a pressure higher than that of the first absorber owing to a pumping transferring the liquid hydrocarbons from the bottom of the aforesaid absorber towards the debutanization column to allow the gaseous distillate to be mixed with the compressed gaseous batch According to a further characterizing feature of this method the debutanization column operates at a pressure lower than that of the first absorber, the gaseous distillate being blended with the gaseous batch upstream of the compression step.

According to still another characterizing feature of the invention there is provided the injection of a cut of non-stabilized gasoline containing a substantial proportion of C4 and lighter hydrocarbons into the debutanization column.

According to still a further characterizing feature of this method the operating step consisting in cooling down the preprocessed gas prior to its injection into the second absorber, reheating the process gas obtained at the head of the second absorber, condensing the reflux from the de-ethanizer, reheating the liquid hydrocarbons obtained at the bottom of the second absorber before their injection into the de-ethanization column and condensing the gaseous distillate from the de-ehtanizer prior to its injection into the head of the second absorber are thermally integrated, the cooling complement being supplied by a refrigeration cycle.

According to another characterizing feature of the method the aforesaid refrigeration cycle makes use of a coolant mixture consisting of at least one C2-hydrocarbon and a C3-hydrocarbon.

According to still a further characterizing feature of the method the aforesaid refrigeration cycle makes use of at least two pressure stages for the vaporization of the previouly sub-cooled coolant.

According to another characterizing feature of the method the aforesaid refrigeration cycle makes use of a total condensation of the coolant performed at a high pressure and room temperature.

The invention is also directed to a plant for carrying out the method complying with either one of the characterizing features referred to hereinabove and of the kind comprising a means for compressing a gaseous charge, load or batch and several absorption columns, characterized in that it comprises: a column for absorbing C5 and heavier hydrocarbons associated with a debutanization column; a column for absorbing C3 and heavier hydrocarbons associated with a de-ethanization column and with a heat exchange system connected to a refrigerating circuit; the liquid cut obtained at the head of the debutanization column being reinjected as a reflux into this column and as a feed into the head of the column for the absorption of the C5-hydrocarbons and the gaseous distillate obtained from the debutanization column being recycled to the compression discharge output of the load gas; the gaseous distillate obtained at the head of the de-ethanization column being at least partially condensed and injected as a feed into the head of the column for the absorption of the C3-hydrocarbons; and the coolant of the refrigeration cycle consisting of a mixture of C2 and C3 and higher C-hydrocarbons being fully condensed at high pressure and room temperature and being after sub-cooling thereof vaporized at two pressure levels.

Figure 2:
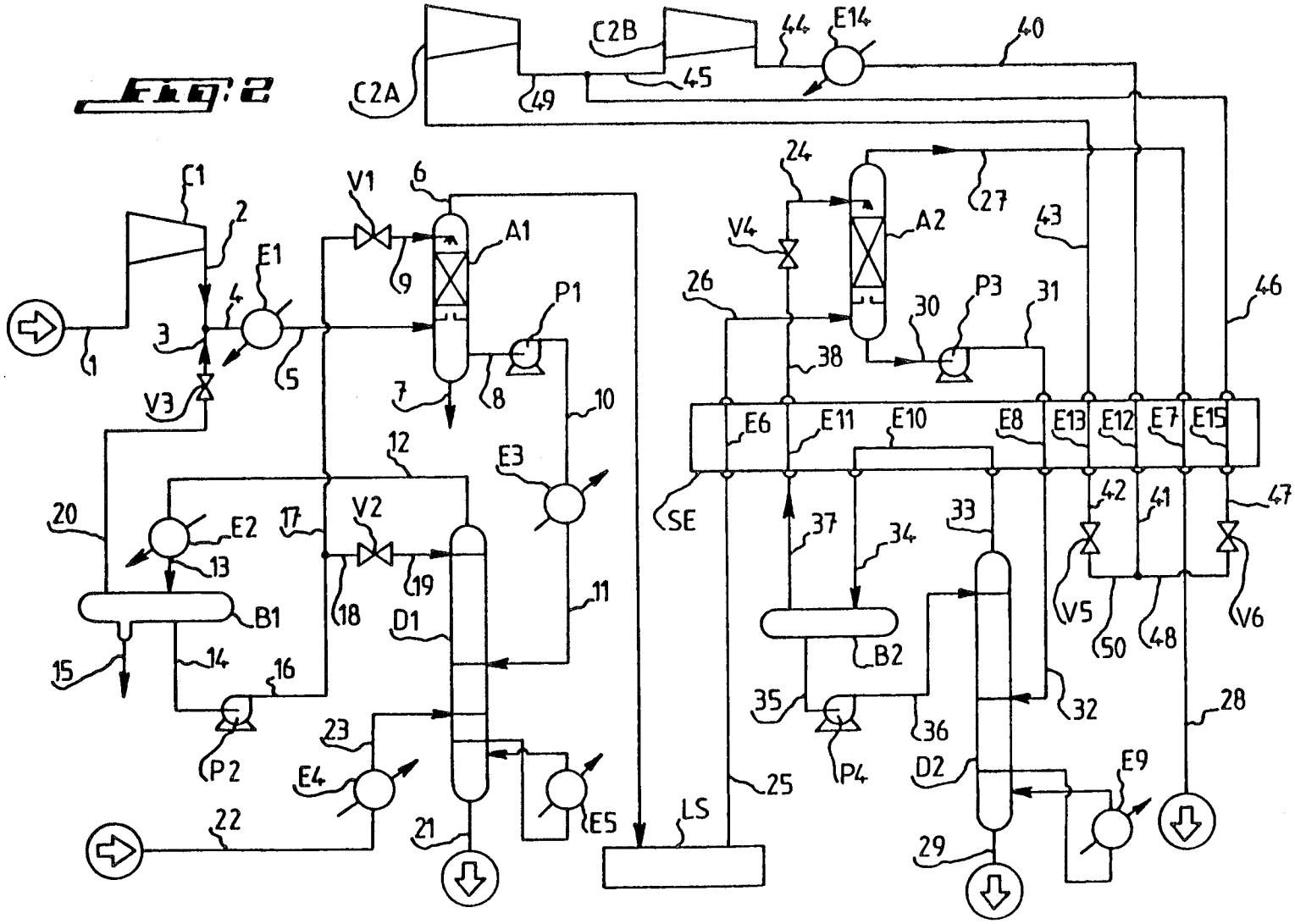

The invention will be better understood and further objects, advantages, details and characterizing features thereof will appear more clearly as the following explanatory description proceeds with reference to the accompanying diagrammatic drawings given by way of non limiting exemple only illustrating a presently preferred specific embodiment of the invention and wherein:

FIG. 1 is a flow sheet diagram showing the essential parts of a plant according to the invention; and FIG. 2 is a diagram fully illustrating a plant according to the invention and incorporating the flow sheet diagram of FIG. 1 as well as a refrigerating system with a mixed coolant.

FIG. 1 illustrating the principle of a plant according to the invention will at first be referred to.

A gaseous batch or load issuing for instance from a catalytic cracking unit is supplied through a pipeline 1 and then compressed in a compressor C1 and discharged through a pipeline 2 before being mixed with the gaseous distillate originating from a debutanization column D1 and supplied through a pipeline 3.

The mixture is transferred through a pipeline 4 to a heat exchanger E1 which cools down and partially condenses the said mixture.

The diphasic mixture issuing from the exchanger E1 is injected through a pipeline 5 into the bottom of a column A1 for the absorption of the C5 and higher C-hydrocarbons. This column comprises a packing or filling bed.

The column head is fed with liquid through a pipeline 9 whereas the gas would leave it through a pipeline 6.

The liquid water possibly present at the bottom of the column A1 is discharged through a pipeline 7 whereas the liquid hydrocarbons are discharged through a duct 8.

These liquid hydrocarbons are transferred through ducts or pipelines 10, 11 by means of a pump P1 towards the higher or top portion of a debutanization column D1 after having been reheated in a heat exchanger E3. The column D1 is fitted with fractionating trays. It is reboiled by a reboiler E5 heated by a circulating reflux or by any other means.

The liquid obtained at the bottom of the debutanization column D1 is discharged through a duct 21 and forms the debutanized gasoline which contains the total amount of the C6 and heavier hydrocarbons and at least 99% of the C5-hydrocarbons and at most 2% of the C4-hydrocarbons present in the gaseous batch.

The gas obtained at the head of the column D1 is discharged through a duct 12 and it is partially condensed in a condensor E2. The diphasic mixture thus obtained is introduced through a duct 13 into a flask or like tank B1. The non-condensed gas of this flask also called gaseous distillate from the debutanization column is discharged through a pipeline 20 to be injected through a valve V3 into the duct 3 for being recycled into the compressed batch, load or charge.

The liquid water which is possibly present is discharged from the flask B1 by the duct 15. The liquid hydrocarbons recovered or collected within the flask B1 are pumped through the agency of a pipeline 14 by a pump P2 and discharged or delivered into a pipeline 16 for being separated into two portions. A first portion provides the reflux of the column D1 through a pipeline 18, a valve V2 and a pipeline 19. A second portion is injected as an absorption liquid into the head of the column A1 through the duct 17, the valve D1 and the pipeline 9.

A cut 22 of non-stabilized gasoline (rich in C4 and lighter hydrocarbons) is reheated in an exchanger E4 and injected through the pipeline 23 into the lower or bottom part of the column D1.

The pretreated gas issuing from the column A1 via the pipeline 6 is processed in a conventional washing and drying unit LS which needs not to be described. The washed and dried pretreated gas would issue from this unit through the pipeline 25 for being cooled down within the heat exchanger E6. The diphasic mixture produced in the exchanger E6 is injected via the pipeline 26 into the column A2 for the absorption of the C3 and higher C-hydrocarbons.

This column comprises a packing or filling bed.

The column head is fed with liquid through a duct 24 whereas the gas would leave it through a duct 27.

The liquid hydrocarbons are discharged from the column A2 through a duct 30.

These liquid hydrocarbons are transferred through pipelines 31, 32 by means of a pump P3 towards a de-ethanization column D2 after having been reheated in a heat exchanger E8. The column D2 is fitted with fractionating trays. It is reboiled by a reboiler E9 heated by a circulating reflux or by any other means.

The liquid obtained at the bottom of the de-ethanization column D2 is discharged through a duct 29 and constitutes the liquified (C3/C4) gases which contain the total amount of the C4 and heavier hydrocarbons and at least 98% of the C3-hydrocarbons and at most 2% of the C2-hydrocarbons present in the pretreated gas.

The gas obtained at the head of the column D2 is discharged through a duct 33 and it is partially condensed in a condenser E10. The diphasic mixture thus obtained is fed through a duct 34 into a flask or tank B2. The non-condensed gas of this flask also called gaseous distillate from the de-ethanization column is discharged through a duct 37 for being cooled down and at least partially condensed in a heat exchanger E11. At the outlet of the exchanger E11 the diphasic mixture is discharged through a duct 38 towards the expansion valve V4 for being injected into the column A2 through the duct 24.

The liquid hydrocarbons recovered or collected in the reflux flask or tank B2 are pumped through the medium of a duct 35 by a pump P4 and discharged or delivered into a pipeline 36 for being injected through the duct 36 as a reflux into the column D2.

The treated gas issuing from the column A2 via the pipeline 27 is reheated up to room temperature in a heat exchanger 37 for being discharged through the pipeline 28 towards the refinery gas network or system.

Reference should now be had to FIG. 2 which shows a complete plant according to the present invention and into which is incorporated the diagram of FIG. 1 with the same reference numerals and which illustrates the thermal integration and the refrigeration cycle.

The heat exchangers E6, E11, E10, E8 and E7 are here integrated into a heat exchanging system SE consisting of plate exchangers; i.e. they are ducts of this heat exchanging system.

A mixed coolant fully condensed at high pressure and room temperature is supplied through a duct 40 towards a duct E12 of the exchange system SE for being sub-cooled there. The sub-cooled coolant is discharged through the duct 41 for being separated into two portions. A first portion flowing in the duct 50 is expanded to a low pressure in the valve V5 for being carried to the duct E13 of the exchange system SE and for being vaporized there. The vapor thus provided is carried through a duct 43 to the first stage of the coolant compressor C2A for being compressed there to the mean pressure and discharged through the duct 49. A second portion flowing in the duct 48 is expanded to the mean pressure in the valve V6 for being carried by the duct 47 to the duct E15 of the exchange system SE and for being vaporized there to a mean pressure and discharged by the duct 46.

The main pressure vapor flowing in the duct 46 is mixed with that which is supplied from the duct 49. The mixture is then carried by the duct 45 to the second stage of the coolant compressor C2B for being compressed there to the high pressure and discharged by the duct 44 towards a coolant condenser E14 for being cooled there down to the room temperature and fully condensed and discharged through the duct 40.

A concrete, figured-out operating example of an embodiment according to the diagram shown on FIG. 2 is given hereinafter.

The gas 1 to be processed is the gas obtained at the head of the primary fractionating in the catalytic cracking step (not shown) after condensation of the gasoline. It is available at 40° C., 190 kPa and is saturated with water. Its flow rate is 1,063.1 kilomoles/h and its composition on an anhydrous basis is the following:

| | |
|---|---|
| Nitrogen | 2.07% mole |
| Gaseous carbon dioxide | 0.43% mole |
| Carbon monoxide | 0.15% mole |
| Hydrogen sulfide | 4.68% mole |
| Hydrogen | 15.15% mole |
| Methane | 15.19% mole |
| Ethane | 5.64% mole |
| Ethylene | 6.35% mole |
| Propane | 3.29% mole |
| Propylene | 10.94% mole |
| Isobutane | 5.49% mole |
| N-butane | 1.90% mole |
| Butylenes | 10.75% mole |
| Isopentane | 3.29% mole |
| N-pentane | 0.73% mole |
| Pentenes | 6.76% mole |
| C6+ hydrocarbons | 6.20% mole |

The gas 1 is compressed to 900 kPa by the compressor C1; the gas 2 discharged from the compressor C1 is mixed with 43.24 kilomoles/h of recycled gas 3; the mixture 4 obtained is cooled in the exchanger E1 down to 35° C. to yield the diphasic flux 5 which feeds the absorber A1.

The absorption column A1 comprises a packing or filling bed equivalent to 14 theoretical trays. It is fed at the head with an absorption liquid 9 rich in C4-hydrocarbons and which is the liquid distillate from the debutanizer D1.

The liquid 9 is at 40° C., its flow rate is 197.33 kilomoles/h and its composition is the following:

| | |
|---|---|
| Nitrogen | 0.01% mole |
| Gaseous carbon dioxide | 0.04% mole |
| Hydrogen sulfide | 1.74% mole |
| Hydrogen | 0.02% mole |
| Methane | 0.40% mole |
| Ethane | 2.09% mole |
| Ethylene | 1.26% mole |
| Propane | 5.07% mole |
| Propylene | 14.23% mole |
| Isobutane | 19.43% mole |
| N-butane | 8.15% mole |
| Butylenes | 46.81% mole |
| Isopentane | 0.09% mole |
| Pentenes | 0.65% mole |

In the column A1, the liquid absorbs the C5 and higher C-compounds contained in the gas and in the column head is obtained a pretreated gas practically devoid of C5-hydrocarbons and containing all the C3-hydrocarbons and 98% of the C4-hydrocarbons present in the charge or batch.

The pressure of the gas at 6 is 870 kPa, its temperature is 18.9° C. and its flow rate is 949.25 kilomoles/h. Its molar composition is:

| | |
|---|---|
| Nitrogen | 2.32% mole |
| Gaseous carbon dioxide | 0.48% mole |
| Carbon monoxide | 0.16% mole |
| Hydrogen sulfide | 5.33% mole |
| Hydrogen | 18.10% mole |
| Methane | 17.09% mole |
| Ethane | 6.48% mole |
| Ethylene | 7.24% mole |
| Propane | 4.00% mole |
| Propylene | 13.16% mole |
| Isobutane | 7.33% mole |
| N-butane | 2.53% mole |
| Butylenes | 15.53% mole |
| Isopentane | 0.04% mole |
| Pentenes | 0.21% mole |

The gas 6 is carried to a washing and drying unit LS where it is freed from the hydrogen sulfide, the gaseous carbon dioxide and the water.

At the outlet of this unit the dry preprocessed gas 25 is at 22° C. and 800 kPa; its composition is the following:

| | |
|---|---|
| Nitrogen | 2.46% mole |
| Carbon monoxide | 0.17% mole |
| Hydrogen | 19.21% mole |
| Methane | 18.15% mole |
| Ethane | 6.88% mole |
| Ethylene | 7.69% mole |
| Propane | 4.24% mole |
| Propylene | 13.97% mole |
| Isobutane | 7.79% mole |
| N-butane | 2.69% mole |
| Butylenes | 16.48% mole |

-continued

| | |
|---|---|
| C5-hydrocarbons | 0.27% mole |

In the column A1 the bottom liquid is separated so that there are obtained a stream of water 7 and a liquid 8 the temperature and flow rate of which are 32.86° C. and 350.42 kilomoles/h, respectively, the molar composition being the following:

| | |
|---|---|
| Nitrogen | 0.01% mole |
| Gaseous carbon dioxide | 0.04% mole |
| Hydrogen sulfide | 1.50% mole |
| Hydrogen | 0.15% mole |
| Methane | 0.85% mole |
| Ethane | 1.73% mole |
| Ethylene | 1.24% mole |
| Propane | 2.81% mole |
| Propylene | 8.15% mole |
| Isobutane | 9.09% mole |
| N-butane | 3.90% mole |
| Butylenes | 19.80% mole |
| Isopentane | 9.82% mole |
| N-Pentane | 2.19% mole |
| Pentenes | 20.08% mole |
| C6+ hydrocarbons | 18.59% mole |

The liquid 8 is pumped by the pump P1 to a pressure of 1,250 kPa, reheated in the exchanger E3 to yield a diphasic mixture 11 at 90° C. and 1,200 kPa which feeds the column D1 with the theoretical tray 14.

The column D1 is also fed with the gasoline 22 obtained at the condenser of the primary fractionating step (not shown). This gasoline available at 40° C. and 1,250 kPa is reheated to 120° C. in the exchanger E4. The flow rate of the gazoline is 656.6 kilomoles/h and its composition is the following:

| | |
|---|---|
| Hydrogen sulfide | 0.14% mole |
| Hydrogen | 0.01% mole |
| Methane | 0.11% mole |
| Ethane | 0.23% mole |
| Ethylene | 0.18% mole |
| Propane | 0.45% mole |
| Propylene | 1.32% mole |
| Isobutane | 1.73% mole |
| N-butane | 0.86% mole |
| Butylenes | 5.20% mole |
| Isopentane | 3.44% mole |
| N-Pentane | 1.06% mole |
| Pentenes | 8.33% mole |
| C6+ hydrocarbons | 76.94% mole |

The debutanizer D1 comprises 42 theoretical fractionating trays. The feeds 11 and 23 are injected onto the stages 17 and 28, respectively, of a column as numbered from the top of this column. The column D1 is reboiled by the reboiler E5 the heating fluid of which is the intermediate circulating reflux from the primary fractionating step (not shown).

At the bottom of the column D1 is obtained the gasoline 21 the flow rate of which is 770.34 kilomoles/h with the following composition:

| | |
|---|---|
| Isobutane | 0.01% mole |
| N-butane | 0.23% mole |
| Butylenes | 0.13% mole |
| Isopentane | 7.43% mole |
| N-Pentane | 1.91% mole |
| Pentenes | 16.16% mole |

-continued

| | |
|---|---|
| C6+ hydrocarbons | 74.13% mole |

The gaseous flux 12 obtained at the head of the column D1 is partially condensed and cooled down to 40° C. in the cooler E2 and then separated in the flask B1 between the gas 20, the aqueous phase 15 and the liquid hydrocarbons 14. The gas 20 has the following composition:

| | |
|---|---|
| Nitrogen | 0.28% mole |
| Gaseous carbon dioxide | 0.30% mole |
| Carbon monoxide | 0.02% mole |
| Hydrogen sulfide | 6.44% mole |
| Hydrogen | 1.30% mole |
| Methane | 6.82% mole |
| Ethane | 8.12% mole |
| Ethylene | 7.11% mole |
| Propane | 6.69% mole |
| Propylene | 21.84% mole |
| Isobutane | 11.87% mole |
| N-butane | 3.74% mole |
| Butylenes | 25.29% mole |
| Pentanes | 0.02% mole |
| Pentenes | 0.15% mole |

This gas available at 970 kPa is injected by the the valve V3 into the compressed load upstream of the exchanger E1 as described hereinabove.

The liquid 14 is pumped by the pump P2 and the flux 16 thus obtained is divided into two parts 17 and 18. The liquid 18 is injected as a reflux into the column D1 through the medium of the valve V2. The liquid 17 is expanded in the valve V1 to yield the flux 9 which is injected into the head of the column A1 as previously stated.

The dry gas 25 is cooled down to −49° C. in the duct E6 of the exchange system SE consisting of plate exchangers and then injected into the column A2 for the absorption of the C3-hydrocarbons.

The column A2 operates under 770 kPa and comprises 14 theoretical separating stages. It is fed at the head with the diphasic mixture 24 the temperature of which is −86° C. and the flow rate is 83.87 kilomoles/h and the molar composition of which is the following:

| | |
|---|---|
| Nitrogen | 0.46% mole |
| Carbon monoxide | 0.05% mole |
| Hydrogen | 1.06% mole |
| Methane | 17.16% mole |
| Ethane | 44.06% mole |
| Ethylene | 36.81% mole |
| Propane | 0.01% mole |
| Propylene | 0.39% mole |

The liquid portion (97%) of this mixture allows to absorb the quasi-total amount of the C3 and C4 hydrocarbons present in the gas feeding the column A2.

The column provides at the head a treated gas 27 of which the temperature is −82° C., the flow rate is 87.05 kilomoles/h and the pressure is 770 kPa.

This gas 27 is then reheated to 17° C. in the duct E7 of the heat exchange system SE and leaves the unit at the pressure of 740 kPa. Its composition is the following:

| | |
|---|---|
| Nitrogen | 4.52% mole |
| Carbon monoxide | 0.32% mole |

-continued

| | |
|---|---|
| Hydrogen | 35.27% mole |
| Methane | 33.31% mole |
| Ethane | 12.30% mole |
| Ethylene | 14.10% mole |
| Propylene | 0.16% mole |

The liquid hydrocarbons 30 recovered at the bottom of the column A2 are at −49.4° C. Their flow rate is 490.92 kilomoles/h and their molar composition is the following:

| | |
|---|---|
| Nitrogen | 0.08% mole |
| Carbon monoxide | 0.01% mole |
| Hydrogen | 0.18% mole |
| Methane | 2.93% mole |
| Ethane | 7.85% mole |
| Ethylene | 6.29% mole |
| Propane | 7.73% mole |
| Propylene | 25.34% mole |
| Isobutane | 14.18% mole |
| N-butane | 4.89% mole |
| Butylenes | 30.02% mole |
| C5-hydrocarbons | 0.49% mole |

The liquid 30 is pumped by the pump P3 and reheated to 17° C. in the duct E8 of the exchange system SE. It is then fed into the de-ethanization column D2.

This column comprises 28 theoretical fractionating trays and operates under a pressure of 1,650 kPa. Its bottom temperature is 70° C. so that its reboiler E9 may be heated with the heat of low thermal level.

At the column head the gas 33 is condensed in the duct E10 of the heat exchange system SE. The diphasic mixture 34 is fed into the flask B2 where are separated a vapor phase 37 and a liquid 35 which is conveyed to the column D2 as a reflux through the agency of the pump P4. The vapor phase 37 is at −32° C., and 1,600 kPa; it is cooled down to −79° C. and 1,550 kPa and partially condensed in the duct E11 of the exchange system SE; it is then expanded in the valve V4 to yield the flux 24.

The liquid 29 obtained at the bottom of the column D2 consists merely only of C3 and C4-hydrocarbons. Its flow rate is 407.06 kilomoles/h and its composition is the following:

| | |
|---|---|
| Ethane | 0.39% mole |
| Ethylene | 0.01% mole |
| Propane | 9.31% mole |
| Propylene | 30.48% mole |
| Isobutane | 17.10% mole |
| N-butane | 5.90% mole |
| Butylenes | 36.21% mole |
| C5 hydrocarbons | 0.59% mole |

The coolant which supplies the cooling contribution necessary to the exchange system SE consists of a mixture of hydrocarbons the molar composition of which is the following:

| | |
|---|---|
| Ethane | 15.00% mole |
| Ethylene | 15.00% mole |
| Propane | 67.00% mole |
| Propylene | 1.00% mole |
| C4 hydrocarbons | 2.00% mole |

The coolant 40 fully condensed at 35° C. and 2,410 kPa and the molar flow rate of which is 901.6 kilomoles/h is sub-cooled down to −49° C. in the duct E12 of the heat exchange system SE.

The liquid 41 thus cooled is divided into two portions. A first portion 50 the flow rate of which is 400 kilomoles/h is expanded in the valve V5 down to a pressure of 275 kPa and fully vaporized in the duct E13 of the system SE.

The gas 43 obtained through vaporization at low pressure of the flux 42 at −25° C., and 250 kPa is compressed to 830 kPa in the first stage of the coolant compressor C2A.

The second portion of liquid obtained by dividing the flux 41 and which constitutes the flux 48 is expanded down to 850 kPa in the valve V6. It is then vaporized in the duct E15 of the heat exchange system SE from which it is discharged at 30° C. and 830 kPa. The gaseous flux 46 thus formed is mixed with the flux 49 to yield a gaseous mixture 45 which is at 32.2° C. and 830 kPa. This mixture 45 is compressed to 2,450 kPa in the second stage C2B of the coolant compressor. The flux 44 discharged from the compressor C2B is fully condensed in the exchanger E14 where it is cooled down to 35° C. to yield the flux 40 previously described.

It should be understood that the invention is not at all limited to the embodiment described and illustrated which has been given by way of example only.

What is claimed is:

1. A method for recovering liquid hydrocarbons contained in a gaseous batch containing light hydrocarbons of less than 3 carbons atoms and heavier hydrocarbons of 3 or more carbon atoms, compressing the batch, condensing it partially and injecting it into a first absorber provided with an upper portion and a lower portion to produce at the upper portion a pretreated gas and at the lower portion heavier hydrocarbons which are treated in a first distillation column wherein light hydrocarbons are removed leaving heavier hydrocarbons, washing and drying the thus treated gas then cooling it and injecting it into a second absorber to produce at an upper portion the treated gas and at a lower portion liquid hydrocarbons which are treated in a second distillation column wherein light hydrocarbons are removed to produce heavier hydrocarbons, comprising:

injecting the heavier hydrocarbons at the lower portion of the first absorber into a debutinization column to obtain at a lower portion of the debutinization column, a liquid cut which contains all of the hydrocarbons of 6 of more carbon atoms, at least 90% of the hydrocarbons of 5 carbon atoms, at most 2% of the hydrocarbons of 4 carbon atoms present in the branch and being free of hydrocarbons of 3 or fewer carbon atoms while at the upper portion of the same column a liquid cut rich in C4 and lighter hydrocarbons is obtained and reinjected as a reflux into said column and as a feed into the upper portion of the first absorber, and a gaseous distillate is recycled into the gaseous batch upstream of the first absorber, injecting the liquid hydrocarbons from the lower portion of the second absorber after reheating into a de-ethanization column to obtain at the lower portion of said de-ethanization column a liquid cut which contains at least 90% of the hydrocarbons of 3 carbon atoms and the total amount of the hydrocarbons of 4 carbon atoms present in the treated gas and obtaining at the upper portion of said column a liquid cut rich in hydrocarbons of 2 or fewer carbon atoms, reinjecting the same as a reflux into said column and as a gaseous distillate rich in hydrocarbons of 2 or fewer carbon atoms which after cooling and at least partial condensation is injected as a feed into the upper portion of the second absorber, whereby at least 90% of the hydrocarbons of 3 carbon atoms and at least 99.9% of the of 4 or more carbon atoms hydrocarbons contained in the gaseous batch are recovered, and the pretreated gas issuing from the first absorber contains all of the hydrocarbons of 3 or fewer carbon atoms, at least 98% of the hydrocarbons of 4 carbon atoms and at most 1% of the hydrocarbons of 5 carbon atoms, while being free of hydrocarbons of 6 or more carbon atoms.

2. A method according to claim 1, wherein the debutinization column operates at a pressure higher than that of the first absorber, said higher pressure being obtained by pumping the liquid hydrocarbons from the lower portion of said absorber towards the debutinization column to allow the gaseous distillate to be mixed with the compressed gaseous batch.

3. A method according to claim 1, wherein the debutanization column operates at a pressure lower than that of the first absorber, the gaseous distillate being mixed with the gaseous batch upstream of the compression step.

4. A method according to claim 1, further consisting in injecting a cut of non-stabilized gasoline containing a substantial proportion of C4 and lighter hydrocarbons into the debutanization column.

5. A method according to claim 1 wherein the steps consisting in cooling the pretreating gas prior to its injection into the second absorber, reheating the treated gas obtained at the upper portion of the second absorber, condensing the reflux of the de-ethanizer, reheating the liquid hydrocarbons obtained at the lower portion of the second absorber prior to injection into the de-ethanization column and condensing the gaseous distillate from the de-ethanizer prior to its injection into the upper portion of the second absorber are thermally integrated, the cooling complement being supplied by a refrigeration cycle.

6. A method according to claim 5, wherein said refrigeration cycle makes use of a mixed coolant consisting of at least one C2-hydrocarbon and one C3-hydrocarbon.

7. A method according to claim 5, wherein said refrigeration cycle makes use of at least two pressure stages for vaporization of previously sub-cooled coolant.

8. A method according to claim 5, wherein said refrigeration cycle makes use of a total condensation of coolant at high pressure and room temperature.

* * * * *